US011718948B2

(12) United States Patent
Da Riol

(10) Patent No.: US 11,718,948 B2
(45) Date of Patent: Aug. 8, 2023

(54) LAUNDRY TREATMENT APPLIANCE WITH IMPROVED DRAWER

(71) Applicant: Electrolux Appliances Aktiebolag, Stockholm (SE)

(72) Inventor: Daniele Da Riol, Porcia (IT)

(73) Assignee: Electrolux Appliances Aktiebolag

( * ) Notice: Subject to any disclaimer, the term of this patent is extended or adjusted under 35 U.S.C. 154(b) by 130 days.

(21) Appl. No.: 17/263,625

(22) PCT Filed: Aug. 23, 2019

(86) PCT No.: PCT/EP2019/072615
§ 371 (c)(1),
(2) Date: Jan. 27, 2021

(87) PCT Pub. No.: WO2020/043623
PCT Pub. Date: Mar. 5, 2020

(65) Prior Publication Data

US 2021/0285145 A1 Sep. 16, 2021

(30) Foreign Application Priority Data

Aug. 30, 2018 (EP) ..... 18191664

(51) Int. Cl.
*D06F 39/02* (2006.01)

(52) U.S. Cl.
CPC ..... *D06F 39/02* (2013.01); *D06F 39/022* (2013.01)

(58) Field of Classification Search
CPC ..... D06F 39/02; D06F 39/022
USPC ..... 68/17 R
See application file for complete search history.

(56) References Cited

U.S. PATENT DOCUMENTS 3,207,373 A * 9/1965 Dannenmann ..... D06F 39/022 68/17 R
8,943,859 B2 2/2015 Sung et al.

FOREIGN PATENT DOCUMENTS

| | | | |
|---|---|---|---|
| CN | 201260565 | Y | 6/2009 |
| CN | 102587087 | A | 7/2012 |
| CN | 203977519 | U | 12/2014 |
| CN | 207638647 | U | 7/2018 |
| EP | 0032682 | A1 | 7/1981 |

(Continued)

OTHER PUBLICATIONS

KR100820739B1—machine translation (Year: 2008).*

(Continued)

*Primary Examiner* — Tinsae B Ayalew
(74) *Attorney, Agent, or Firm* — RatnerPrestia

(57) ABSTRACT

A laundry treatment appliance having a cabinet accommodating a laundry treatment chamber and a drawer adapted to slide into the cabinet. The drawer has external walls defining the external shape of a portion of the drawer, and at least one compartment for containing laundry treatment agent. Said compartment is delimited at least partially by at least a portion of at least one external wall, which has an emptying hole. Said emptying hole is in fluid communication with the at least one compartment. The drawer comprises a closure device adapted to be operated for selectively closing and opening said emptying hole. Said closure device is arranged on an external side of the external wall so as to be accessible and operated by a user externally to the drawer for closing and opening the corresponding emptying hole.

11 Claims, 7 Drawing Sheets

(56) References Cited

FOREIGN PATENT DOCUMENTS

| | | | |
|---|---|---|---|
| EP | 2281939 | A1 | 2/2011 |
| EP | 2733249 | | 5/2014 |
| EP | 2881510 | | 6/2015 |
| JP | 5464866 | A | 5/1979 |
| JP | 01230333 | A | 9/1989 |
| JP | 11140934 | A | 5/1999 |
| KR | 100820739 | | 4/2008 |
| KR | 20140131809 | A | 11/2014 |

OTHER PUBLICATIONS

KR20140131809A—machine translation (Year: 2014).*
International Search Report and Written Opinion for International Application No. PCT/EP2019/072615, dated Oct. 21, 2019, 8 pages.
Chinese Office Action for Chinese Application No. 201980056112.X, dated Jul. 22, 2022, with translation, 20 pages.

* cited by examiner

LAUNDRY TREATMENT APPLIANCE WITH IMPROVED DRAWER

This application is a U.S. National Phase application of PCT International Application No. PCT/EP2019/072615, filed Aug. 23, 2019, which claims the benefit of European Application No. 18191664.4, filed Aug. 30, 2018, both of which are incorporated by reference herein.

FIELD OF THE INVENTION

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing appliances and laundry washing appliances also implementing laundry drying functions (also referred to as washers/dryers). More particularly, the present invention relates to closure devices for closing and opening emptying holes of drawer compartments.

BACKGROUND OF THE INVENTION

As it is well known, laundry appliances comprise a laundry treatment chamber wherein items to be treated (e.g., washed, rinsed and additionally dried) are placed to be subjected to various laundry treatment operations.

Making reference to a laundry washing machine (but similar considerations also apply to combined laundry washing and drying machines), such laundry treatment operations involve the use of detergent substances, in powder and/or in liquid form, and of possible additional substances, such as for example softening agents, and rinsing agents, which will be defined in the present description as a whole as "laundry treatment agents".

During some phases of laundry treatment operations, amounts of such laundry treatment agents should be delivered into the laundry treatment chamber in a controlled way. For this purpose, the laundry washing machine is equipped with a laundry treatment agents dispensing system comprising one or more laundry treatment agent containers adapted to be loaded with amounts of laundry treatment agents, and delivery devices for delivering into the laundry treatment chamber controlled amounts of the laundry treatment agents contained in the laundry treatment agent containers.

Making reference to a front-loading washing machine, the laundry treatment agent containers of the dispensing system are usually implemented as compartments of a drawer, which can be (at least partially) extracted from a front portion of the washing machine cabinet.

As it is well known to those skilled in the art, the compartments of the drawer can be configured to be loaded by a user with single, individual doses of laundry treatment agents, e.g., with an amount of laundry treatment agent necessary for a laundry treatment cycle on a single load of items, or may have a larger capacity sufficient to store more doses of laundry treatment agents, adapted to be used for more laundry treatment cycles on a plurality of loads of items.

The drawer may be also advantageously provided with means for selectively discharging the laundry treatment agents contained in the drawer compartments when the drawer is at least partially extracted from the washing machine cabinet. In this way, the drawer compartments can be emptied, e.g., with the laundry treatment agents that are collected in proper gathering containers placed under the extracted drawer, and cleaning and/or maintenance operations can be carried out on the drawer.

EP2733249 discloses a machine having a supply drawer. At least two storage compartments are arranged in the drawer for receiving detergents. The storage compartments are covered from above by a cover which prevents the detergents from drying out. Door elements are provided on the cover to allow filling of the storage compartments with detergent. For the cleaning of the drawer, the storage compartments are equipped with drain valves arranged below the door elements and by which openings in the bottom of the storage container can be opened or closed. This makes it possible to remove the detergent from the storage compartments, if necessary. Each drain valve has an actuation shaft which projects upwardly from the bottom of the drawer through the respective storage compartments and which allows the user to actuate the valve. Each actuation shaft can be rotated about its vertical axis to open or close the respective opening.

SUMMARY OF INVENTION

The Applicant has found that the solution disclosed in EP2733249 is not efficient because in order to reach the drain valves, a user is forced to insert her/his fingers inside the storage compartments for actuating the actuation shaft. This operations is slow and uncomfortable because it requires the insertion of fingers through small apertures on the cover formed by opening the door elements. Moreover, having to insert her/his finger in the storage compartments for draining detergent forces the user to enter in contact with the detergent contained inside the storage compartments, getting the finger dirty. Moreover, being the drain valves/shafts provided within the drawer, one drain valve can be kept/forgiven opened while the drawer is inserted in the machine, with consequent risks of undue flushing of detergent from the drawer compartment into the machine.

In view of the above, it is an object of the present invention to provide a laundry appliance able to overcome these, as well as other, drawbacks, and particularly it is an object of the present invention to provide a laundry appliance having a drawer whose storage containers can be emptied in a reliable, easy, fast, comfortable and efficient way.

One or more aspects of the present invention are set out in the independent claims, with advantageous features of the same invention that are indicated in the dependent claims.

An aspect of the present invention relates to a laundry treatment appliance comprising a cabinet accommodating a laundry treatment chamber and a drawer adapted to slide into the cabinet.

According to An embodiment of the present invention, the drawer comprises external walls at least partially defining the external shape of a portion of the drawer sliding into the cabinet.

According to an embodiment of the present invention, the drawer further comprises at least one compartment for containing laundry treatment agent.

According to an embodiment of the present invention, said compartment is delimited at least partially by at least a portion of at least one external wall.

According to an embodiment of the present invention, the portion of said at least one external wall of said drawer delimiting said at least one compartment comprises an emptying hole.

According to an embodiment of the present invention, said emptying hole is in fluid communication with the at least one compartment.

According to an embodiment of the present invention, the drawer comprises a closure device adapted to be operated for selectively closing and opening said emptying hole.

According to an embodiment of the present invention, said closure device is arranged on an external side of the external wall so as to be accessible and operated by a user externally to the drawer for closing and opening the corresponding emptying hole.

According to an embodiment of the present invention, the closure device comprises a plug element adapted to be selectively fitted into or extracted from the corresponding emptying hole from outside the drawer.

According to an embodiment of the present invention, said plug element comprises a pin member or a screw member.

According to an embodiment of the present invention, the drawer is made of a first material and said plug element comprises at least one portion made of a second material different than the first material.

According to an embodiment of the present invention, said closure device comprises a sealing portion adapted to seal the emptying hole when the closure device closes the emptying hole in order to avoid spilling of laundry treatment agent from the compartment.

According to an embodiment of the present invention, said plug element comprises a sealing portion adapted to seal the emptying hole when the plug element closes the emptying hole in order to avoid spilling of laundry treatment agent from the compartment.

According to an embodiment of the present invention, the closure device comprises a flap member, said flap member being hingedly coupled to the drawer at the external side of the external wall.

According to an embodiment of the present invention, said flap member supports the plug element.

According to an embodiment of the present invention, said flap member is configured to be moved between:

- a closed position, in which the closure device closes the emptying hole, and
- an open position, in which the closure device opens the emptying hole.

According to an embodiment of the present invention, said flap member is configured to be moved between:

- a closed position, in which the plug element is fitted into the emptying hole, and
- an open position, in which the plug element is unfitted from the emptying hole.

According to an embodiment of the present invention, when the flap member is in the open position, it externally protrudes from the external wall to an extent such to prevent the drawer to completely slide into the cabinet.

According to an embodiment of the present invention, said flap member is flush with the external wall when it is in the closed position.

According to an embodiment of the present invention, said flap member comprises a grip edge for allowing a user to grip the flap member during the movement between the closed and open positions.

According to an embodiment of the present invention, said at least one external wall comprises at least one among a drawer bottom wall opposite to a top side of the drawer and drawer lateral walls each connecting said at least one bottom wall and said top of the drawer.

According to an embodiment of the present invention, said at least one external wall comprises at least one among a drawer bottom wall parallel to a top surface of the cabinet and drawer lateral walls perpendicular to the drawer bottom wall.

According to an embodiment of the present invention, the drawer comprises a marker corresponding to the closure device.

According to an embodiment of the present invention, said marker is visible from the outside of the drawer for allowing the user to visually identify the closure device from the outside of the drawer.

According to an embodiment of the present invention, said marker is at least partially arranged on at least one drawer lateral wall.

According to an embodiment of the present invention, said marker comprises at least one among textual indicators, sign indicators, colored indicators.

According to an embodiment of the present invention, said at least one compartment comprises a compartment adapted to contain a single dose of said laundry treatment agent.

According to an embodiment of the present invention, said at least one compartment comprises a compartment adapted to contain multiple doses of said laundry treatment agent.

According to an embodiment of the present invention, said at least one compartment comprises at least two compartments each one adapted to contain multiple doses of said laundry treatment agent.

According to an embodiment of the present invention, the drawer further comprises for each one of said at least two compartments a corresponding emptying hole and a corresponding closure device adapted to selectively closing and opening the corresponding emptying hole from outside the drawer.

According to an embodiment of the present invention, the drawer further comprises for each one of said at least two compartments a corresponding emptying hole, said closure device comprising, for each one of said at least two compartments, a plug element adapted to be selectively fitted into or unfitted from the corresponding emptying hole from outside the drawer.

According to an embodiment of the present invention, said emptying holes corresponding to such at least two compartments comprise a first emptying hole and a second emptying hole, the first emptying wall and the second emptying wall being located on opposite drawer lateral walls of the drawer.

BRIEF DESCRIPTION OF THE DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
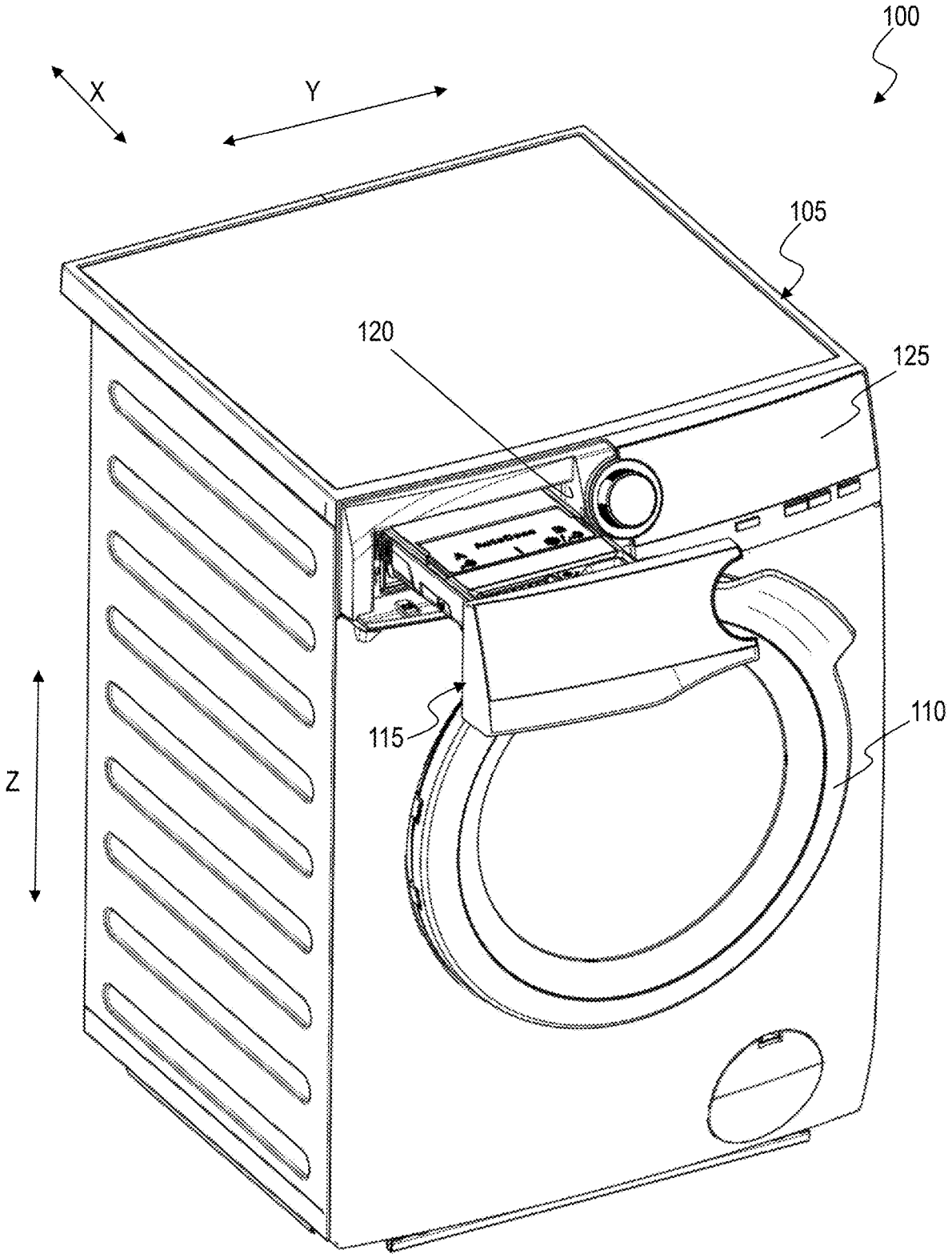
FIGS. 1A and 1B show perspective views of a laundry appliance according to an embodiment of the present invention.
Figure 1B:
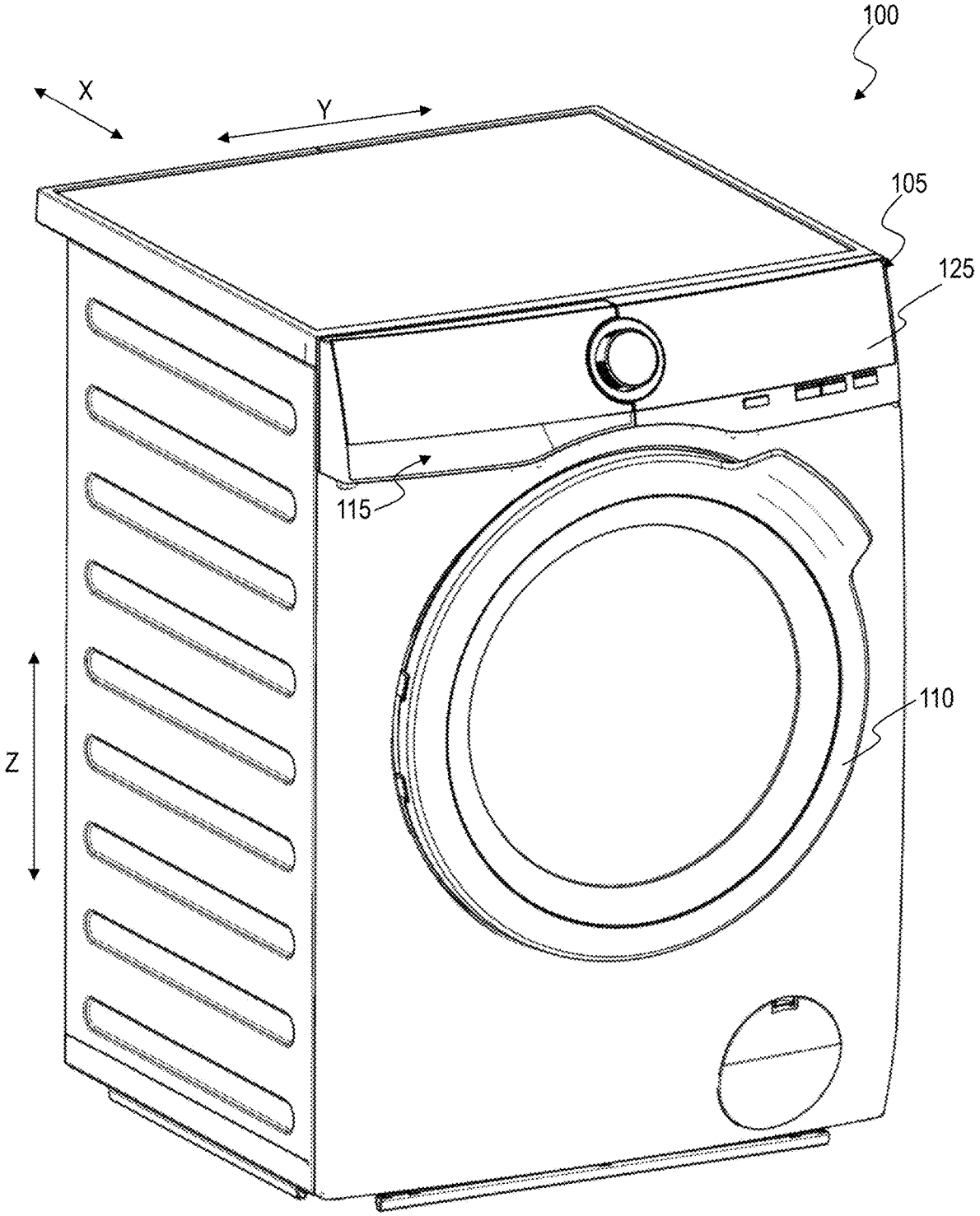

With reference to the drawings, FIGS. 1A and 1B show perspective views of a laundry appliance 100 according to an embodiment of the present invention. According to the exemplary, not limiting, embodiment herein considered, the laundry appliance 100 is a laundry washing machine. In any case, although in the following description explicit reference will be made to a laundry washing machine, this should not to be construed as a limitation; indeed, the present invention applies to other types of laundry appliances, such as for example washer dryers, i.e., laundry washing appliances also implementing laundry drying function.

The laundry appliance 100 comprises a (e.g., parallelepiped-shaped) cabinet 105, which preferably accommodates a laundry treatment chamber for performing a laundry treatment cycle on items housed therein (i.e., a washing cycle on a laundry load in the example herein considered of a laundry washing machine).

The laundry treatment chamber comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pumps and impellers of the hydraulic apparatus, one or more heating elements for heating water/treatment agents/air).

The laundry appliance 100 further comprises a drawer 115 for containing one or more laundry treatment agents, such as liquid and powder treatment agents including, but not limited to, washing detergents, rinsing detergents, bleaches and softeners. The laundry appliance 100 also comprises a drawer seat 120 for housing the drawer 115, the drawer being advantageously configured to slide into the drawer seat 120, along a longitudinal or sliding direction X, between a extracted position (shown in FIG. 1A) and a retracted position (shown in FIG. 1B). The drawer seat 120 is preferably provided on a top part of a cabinet front.

Preferably, the laundry appliance 100 further comprises a user interface 125, the user interface 125 being preferably provided on the top part of the cabinet front, more preferably next to the drawer seat 120 along a transversal direction Y orthogonal to the longitudinal direction X.

Preferably, although not necessarily, the user interface 125 comprises a display unit, not shown, for visually displaying one or more pieces of information; the display unit may for example be a light emitting polymer display (LPD), a liquid crystal display, a thin film transistor-liquid crystal display, or an organic light-emitting diode display.

The user interface 125 preferably comprises one or more control elements (e.g., selection buttons and/or knobs) for allowing the user to select a washing cycle and to control one or more operating parameters of the selected washing cycle (including, but not limited to, temperature, laundry load dirt level, spin speed, start time delay, drawer compartment selection, laundry treatment agent selection). Additionally, as herein exemplary assumed, or alternatively, the user interface 125 preferably comprises one or more status indicators for indicating to the user a status of the laundry appliance 100; for the purposes of the present disclosure, the status indicators are configured to indicate the status of one or more components of the laundry appliances 100 and/or a status of the washing cycle (including, but not limited to, information about a residual time to the end of the ongoing washing cycle, and/or information about a current phase of the ongoing washing cycle, and/or selected parameters for the ongoing washing cycle, and/or selected drawer compartment, and/or selected laundry treatment agent).

Figure 2A:
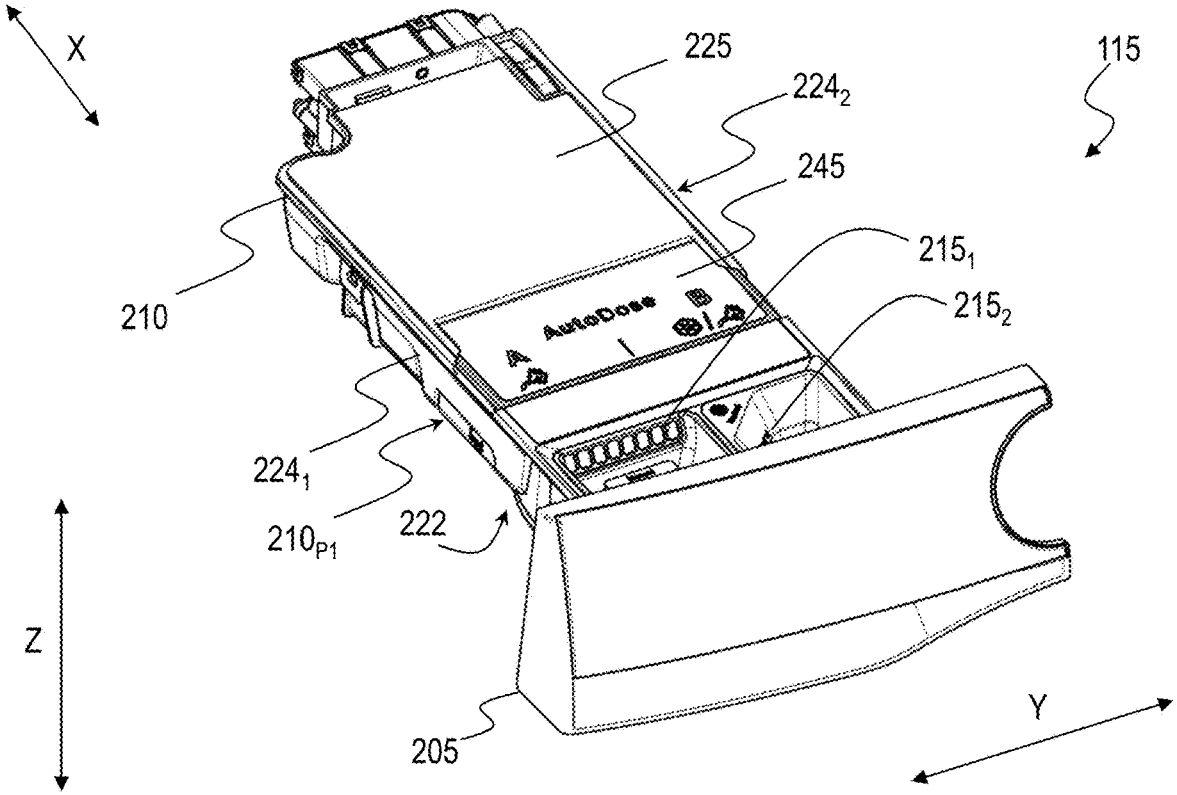
FIG. 2A shows perspective views of the drawer completely disengaged from the drawer seat according to an embodiment of the present invention.
Figure 2A:
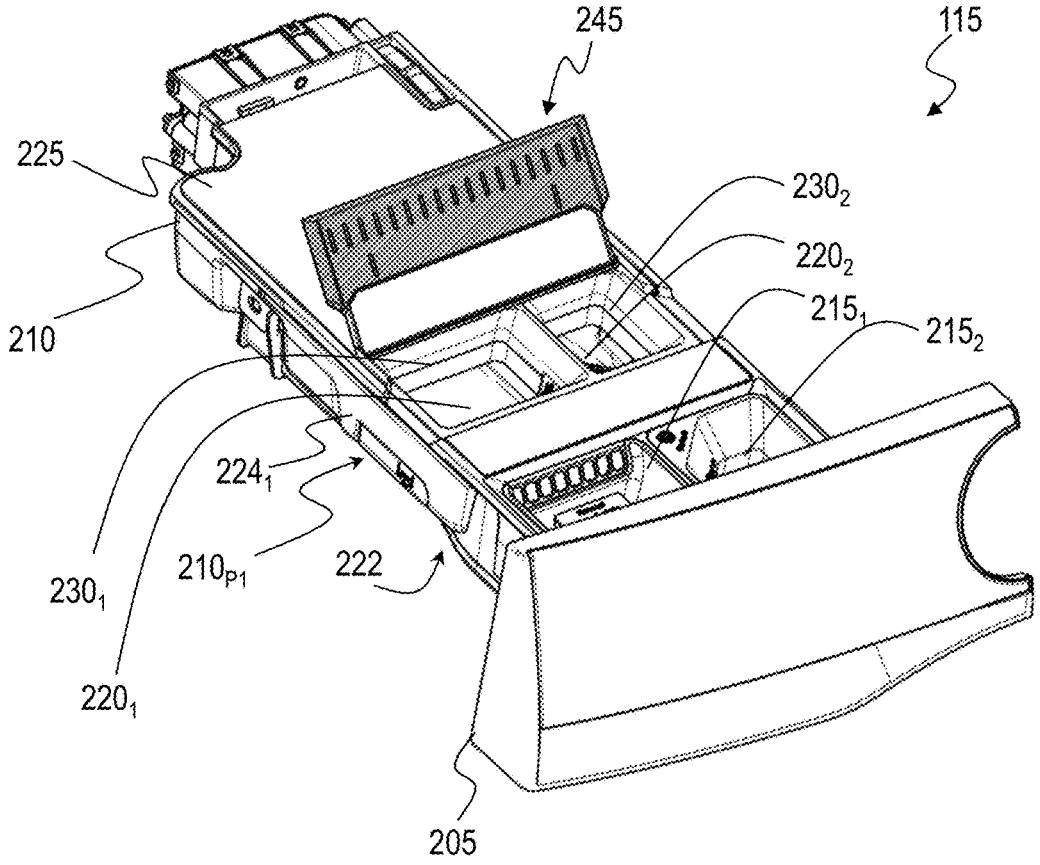

With reference now to FIG. 2A, it shows perspective views of the drawer 115 (completely disengaged from the drawer seat 120) according to an embodiment of the present invention. For ease of description, FIG. 2A will be discussed jointly with FIG. 2B, which shows a perspective exploded view of a portion of the drawer 115 with removed parts.

The drawer 115 preferably comprises a drawer handle 205 allowing the user to slidably move the drawer 115 between the extracted position and the retracted position when it is fitted into the drawer seat 120, and a drawer body 210 to which the drawer handle 205 is mounted.

The drawer body 210 preferably comprises one or more (two, in the example at issue) drawer compartments $\mathbf{215}_1$, $\mathbf{215}_2$ each one adapted to contain a single dose of a respective laundry treatment agent for performing a single washing cycle, hereinafter referred to as mono-dose compartments $\mathbf{215}_1$,$\mathbf{215}_2$; just as an example, the mono-dose compartment $\mathbf{215}_1$ may be arranged to contain a single dose of a powder or liquid washing detergent, whereas the mono-dose compartment $\mathbf{215}_2$ may be arranged to contain a single dose of a powder or liquid or pearl softener. Additionally, as herein exemplary assumed, or alternatively, the drawer 115 preferably comprises one or more (two, in the example at issue) drawer compartments $\mathbf{220}_1$,$\mathbf{220}_2$ each one adapted to contain multiple doses of a respective laundry treatment agent for performing multiple washing cycles, hereinafter referred to as multi-dose compartments: therefore, the exemplary considered laundry appliance 100 is configured to implement an auto-dosing functionality in which, at each washing cycle (and when the auto-dosing functionality is enabled), a predetermined amount of laundry treatment agent is automatically taken (e.g., by means of a pump, preferably a peristaltic pump, not shown) from one or both of the multi-dose compartments $\mathbf{220}_1$,$\mathbf{220}_2$. Just as an example, the multi-dose compartment $\mathbf{220}_1$ may be arranged to contain multiple doses of a liquid washing detergent, whereas the multi-dose compartment $\mathbf{220}_2$ may be arranged to contain a multiple doses of a liquid softener.

The drawer body 210 comprises external walls at least partially defining the external shape of the drawer 115 portion sliding into the drawer seat 120 (and therefore into the cabinet 105). Said external walls preferably comprise a drawer bottom wall 222 opposite, and preferably parallel, to a top side of the drawer body 210 that preferably identifies a respective access mouth for allowing laundry treatment agent loading inside compartments $\mathbf{215}_1$,$\mathbf{215}_2$, $\mathbf{220}_1$,$\mathbf{220}_2$ from above (i.e., the drawer bottom wall 222 is preferably parallel to a top surface of the cabinet), and two drawer lateral walls $224_1$, $224_2$ connecting the drawer bottom wall 222 with the top side of the drawer, preferably perpendicular to the drawer bottom wall 222. The drawer lateral walls $224_1$, $224_2$ preferably delimit, at least partially, the respective multi-dose compartment $220_1$,$220_2$ and the respective mono-dose compartments $215_1$,$215_2$ preferably along the transversal direction Y, while the drawer bottom wall 222 delimits, at least partially, the multi-dose compartment $220_1$, $220_2$ and the mono-dose compartments $215_1$,$215_2$ along a vertical direction Z orthogonal to the longitudinal X and transversal Y directions.

Preferably, although not necessarily, the mono-dose compartments $215_1$,$215_2$ are formed side by side along the transversal direction Y; more preferably, the mono-dose compartments $215_1$,$215_2$ are formed in an area of the drawer body 210 that, when the drawer handle 205 is mounted on the drawer body 210, is proximal to the drawer handle 205 (hereinafter referred to as front area of the drawer body 210). Preferably, herein assumed, each mono-dose compartment $215_1$,$215_2$ extends in depth (i.e., along the vertical direction Z) from the top of the drawer body 210.

Preferably, the drawer 115 may also comprise one or more adapter components (e.g., cup-shaped containers provided with a siphon assembly) each one configured to be inserted into or removed from a respective mono-dose compartment $215_1$,$215_2$ for adapting it to, respectively, liquid or powder laundry treatment agents. In the example considered, two adapter components are provided, namely a first adapter component $215_{1A}$ configured to be reversibly housed into the mono-dose compartment $215_1$, and a second adapter component $215_{2A}$ configured to be reversibly housed into the mono-dose compartment $215_2$.

Preferably, although not necessarily, the multi-dose compartments $220_1$,$220_2$ are formed side by side along the transversal direction Y. More preferably, the multi-dose compartments $220_1$,$220_2$ are formed in an area of the drawer body 210 (hereinafter referred to as rear area of the drawer body 210) that, along the sliding direction X, is rearward with respect to the front area of the drawer body 210 (i.e., the area of the drawer body 210 where the mono-dose compartments $215_1$,$215_2$ are provided). Even more preferably, as visible in the figures, the front and rear areas of the drawer body 210 are properly different in size, and particularly the rear area of the drawer body 210 is larger than the front area of the drawer body 210 (e.g., the rear area of the drawer body 210 being for example from 2 to 4 times larger than the front area of the drawer body 210); when, as herein exemplary considered, same extensions in depth of the mono-dose $215_1$,$215_2$ and multi-dose $220_1$,$220_2$ compartments are assumed, having the rear area of the drawer body 210 larger than the front area of the drawer body 210 translates into correspondingly different capacities of the mono-dose $215_1$,$215_2$ and multi-dose $220_1$,$220_2$ compartments (with the multi-dose compartments $220_1$,$220_2$ that are sized to store larger amounts of laundry treatment agent as compared to the mono-dose compartments $215_1$,$215_2$).

It has to be appreciated that each one of the mono-dose $215_1$,$215_2$ and multi-dose $220_1$,$220_2$ compartments is preferably at least partially delimited by portions of corresponding drawer external walls. Making for example reference to FIG. 2B, the mono-dose compartment $215_1$ is preferably delimited from below by a portion of the drawer bottom wall 222 and from a side by a portion of the drawer lateral wall $224_1$, the mono-dose compartment $215_2$ is preferably delimited from below by a portion of the drawer bottom wall 222 and from a side by a portion of the drawer lateral wall $224_2$, the multi-dose compartment $220_1$ is preferably delimited from below by a portion of the drawer bottom wall 222 and from a side by a portion of the drawer lateral wall $224_1$, and the multi-dose compartment $215_2$ is preferably delimited from below by a portion of the drawer bottom wall 222 and from a side by a portion of the drawer lateral wall $224_2$.

Figure 2B:
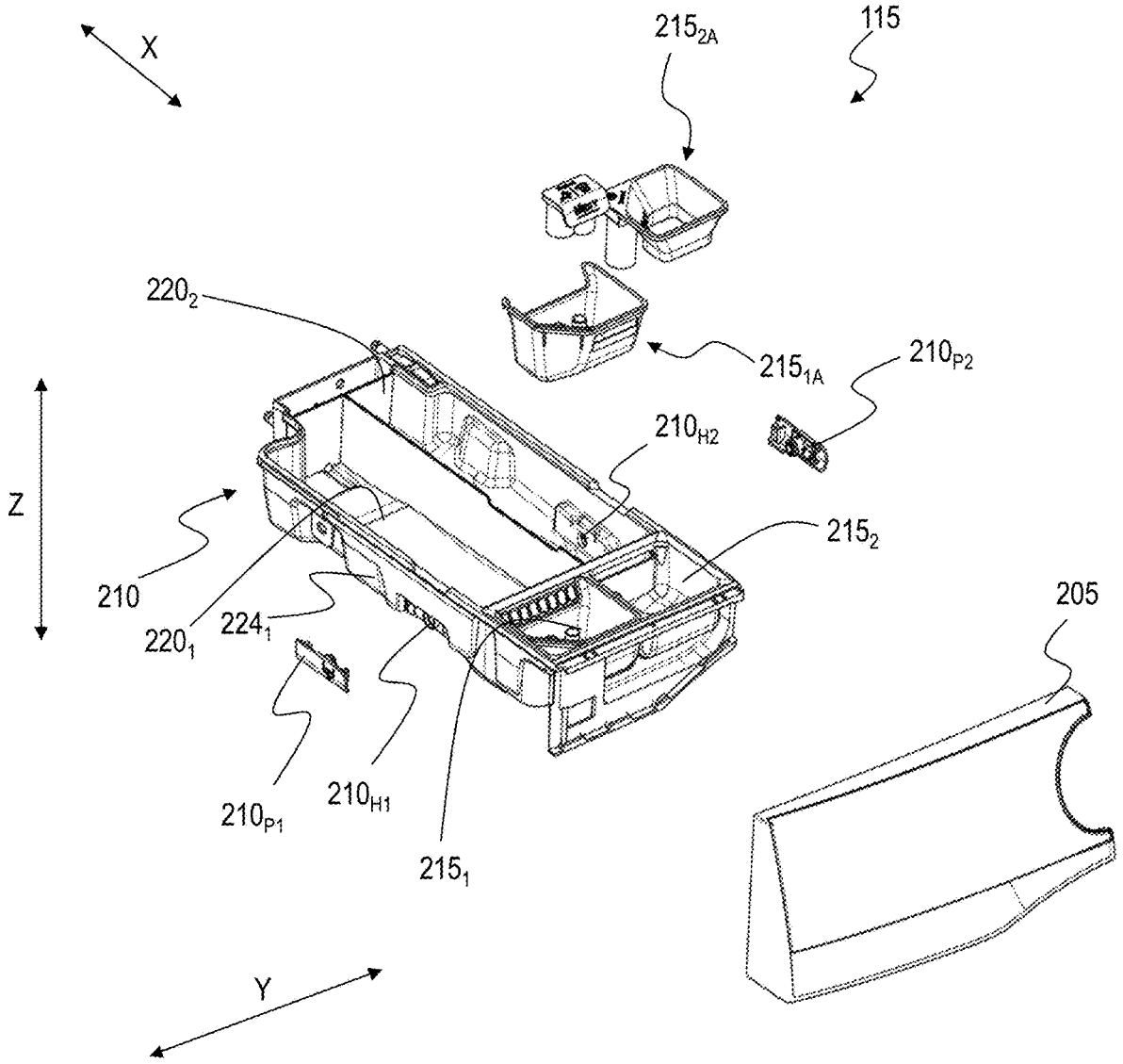
FIG. 2B shows a perspective exploded view of a portion of the drawer of FIG. 2A with removed parts.

Preferably, the drawer 115 also comprises a drawer cover 225 for covering the drawer body 210. In FIG. 2B, the drawer cover 225 has been omitted to illustrate the interior of the multi-dose compartments $220_1$,$220_2$.

The drawer cover 225 is configured to cover the rear area of the drawer body 210, thus leaving uncovered the front area of the drawer body 210, and hence the mono-dose compartments $215_1$,$215_2$; the mono-dose compartments $215_1$,$215_2$ can therefore be directly accessed from above (i.e., through the respective access mouths) for loading the laundry treatment agents therein. Even more preferably, the drawer cover 225 comprises one or more access openings each one for accessing a respective multi-dose compartment $220_1$,$220_2$ for loading the laundry treatment agent; in the example at issue in which the drawer body 210 comprises two multi-dose compartments $220_1$,$220_2$, two access openings $230_1$,$230_2$ are provided in the drawer cover 225.

Preferably, although not necessarily, the access openings $230_1$,$230_2$ are formed in the drawer cover 225 side by side along the transversal direction Y.

The access openings $230_1$,$230_2$ are advantageously formed in a (preferably, recessed) area of the drawer cover 225 that, when the drawer cover 225 is mounted on the drawer body 210, is proximal to the front area of the drawer body 210 (i.e., the area of the drawer body 210 where the mono-dose compartments $215_1$,$215_2$ are provided), or substantially proximal thereto: therefore, a low or relatively low extraction of the drawer 115 is required for allowing the user to load the laundry treatment agents in the multi-dose-compartments $220_1$,$220_2$ (an excessive extraction of the drawer 115 would instead impair the mechanical stability of the drawer 115, essentially due to its elongated shape and/or to its relatively heavy weight, especially when laundry treatment agents are contained therein).

Preferably, one or more access components are provided for selectively covering and uncovering the access openings $230_1$,$230_2$ for respectively preventing and allowing access to the respective multi-dose compartments $220_1$,$220_2$ (in the exemplary considered embodiment, no access components are provided for selectively covering and uncovering the access mouths of the mono-dose compartments $215_1$,$215_2$, however this should not be construed as a limitation).

The access component may for example be a door 245 coupled or coupleable to the drawer cover 225 at the respective access opening $230_1$,$230_2$. According to the advantageous embodiment herein considered and illustrated, the door 245 is a flap door pivotally coupled to the drawer cover 225 so as to be actuatable by the user between an open position (shown in the bottom drawing of FIG. 2A) and a closed position (shown in the top drawing of FIG. 2A) for jointly uncovering and covering, respectively, both the access openings $230_1$,$230_2$. In other words, a single door 245 associated with both access openings $230_1$,$230_2$ is assumed in the exemplary considered embodiment in any case, in alternative embodiments of the present invention, not shown, two doors may be provided, each door being associated with a respective access opening $230_1$,$230_2$.

Preferably, as illustrated, the door is designed to be flush with the top profile of the drawer cover 225 when the door 245 is in the closed position.

As mentioned above, the drawer 115 can be moved between the extracted and retracted positions by acting on the drawer handle 205.

According to an exemplary, not limiting embodiment of the present invention, the drawer handle 205 may be reversibly coupled or connected to the drawer body 210, for example by means of a coupling arrangement associated with the drawer 115. For example, the coupling arrangement may provide for allowing the drawer handle 205 to move with respect to the drawer body 210 along a coupling direction corresponding to the transversal direction Y. Similar considerations apply if the reversible coupling of the drawer handle 205 to the drawer body 210 is attained with a coupling arrangement which allows the drawer handle 205 to move with respect to the drawer body 210 along a different coupling direction, such as for example corresponding to the vertical direction Z or to the longitudinal direction X.

Making reference to FIG. 2B, one or more emptying holes preferably each one in fluid communication with a respective multi-dose compartment $\mathbf{220}_1$,$\mathbf{220}_2$ are provided in the drawer body 210 for emptying the respective multi-dose compartment $\mathbf{220}_1$,$\mathbf{220}_2$, i.e. for discharging it from the laundry treatment agent contained therein (e.g. for maintenance or cleaning of the drawer 115).

According to an embodiment of the present invention, the emptying holes are provided on external walls of the drawer body 210.

More particularly, according to an embodiment of the invention, the empty holes are provided on the drawer lateral walls $\mathbf{224}_1$, $\mathbf{224}_2$. In the example at issue, a first emptying hole $\mathbf{210}_{H1}$ in fluid communication with the multi-dose compartment $\mathbf{220}_1$ is located in the drawer lateral wall $\mathbf{224}_1$, and a second emptying hole $\mathbf{210}_{H2}$ in fluid communication with the multi-dose compartment $\mathbf{220}_2$ is provided in the drawer lateral wall $\mathbf{224}_2$.

According to another embodiment of the invention (not shown) empty holes associated with the multi-dose compartment $\mathbf{220}_1$,$\mathbf{220}_2$ may be additionally or alternatively located on the drawer bottom wall 222.

According to a still further embodiment of the present invention (not shown), emptying holes associated with the mono-dose compartments $\mathbf{215}_1$,$\mathbf{215}_2$ may be provided additionally or alternatively to the emptying holes $\mathbf{210}_{H1}$,$\mathbf{210}_{H2}$. In the same way as for the emptying holes $\mathbf{210}_{H1}$,$\mathbf{210}_{H2}$ associated with the multi-dose compartment $\mathbf{220}_1$,$\mathbf{220}_2$, also the emptying holes associated with the mono-dose compartments $\mathbf{215}_1$,$\mathbf{215}_2$ are provided on external walls of the drawer body 210, i.e. they may be located in the drawer lateral walls $\mathbf{224}_1$, $\mathbf{224}_2$ and/or in the drawer bottom wall 222.

Making reference to the exemplary case illustrated in the figures, each emptying hole $\mathbf{210}_{H1}$,$\mathbf{210}_{H2}$ comprises a circular opening preferably located on a bottom part of the respective drawer lateral wall $\mathbf{224}_1$, $\mathbf{224}_2$.

Figure 3A:
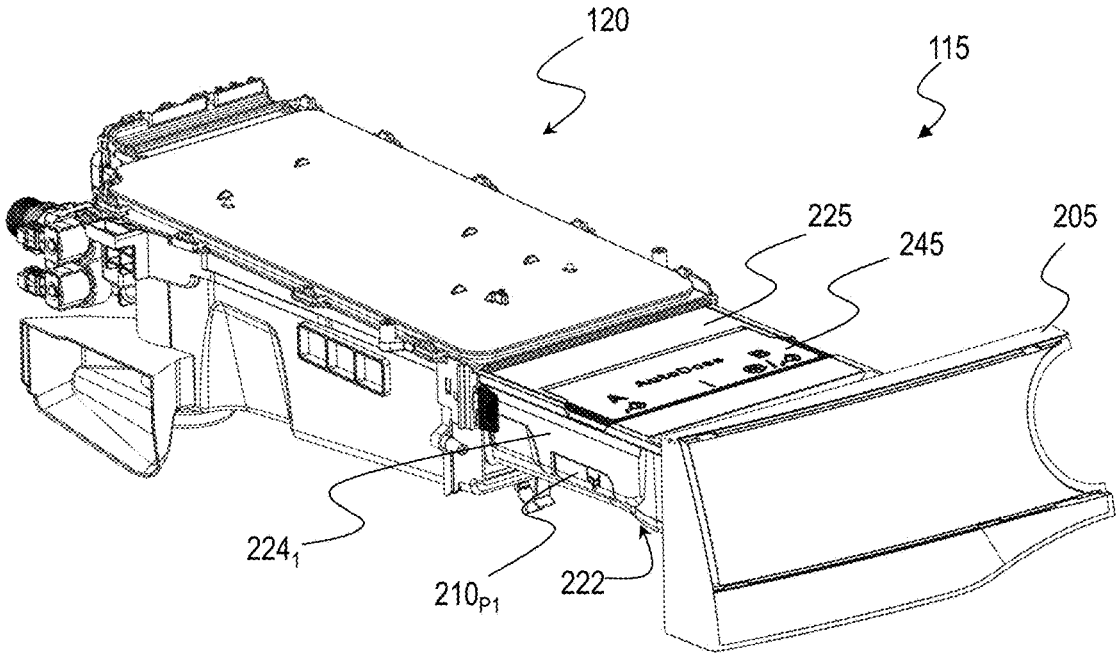
FIGS. 3A and 3B shows perspective views of the drawer of FIGS. 2A-2B with closure devices in a closed position and in an open position, respectively, according to an embodiment of the present invention.
Figure 3B:
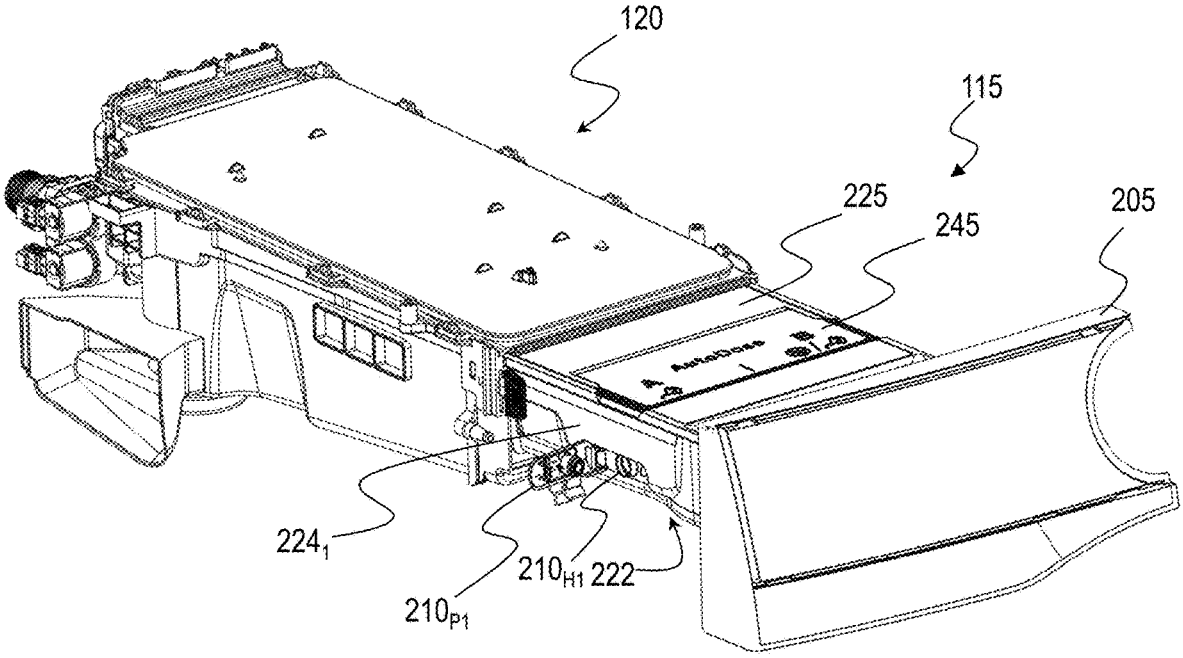

Making reference to the perspective views illustrated in FIGS. 3A and 3B, according to an embodiment of the present invention each emptying hole $\mathbf{210}_{H1}$,$\mathbf{210}_{H2}$ is associated with a respective closure device $\mathbf{210}_{P1}$,$\mathbf{210}_{P2}$ configured to be selectively switched between a closed position (illustrated in FIG. 3A) for closing the respective emptying hole $\mathbf{210}_{H1}$,$\mathbf{210}_{H1}$, and an open position (illustrated in FIG. 3B) for opening the respective emptying hole $\mathbf{210}_{H1}$,$\mathbf{210}_{H2}$.

According to an embodiment of the present invention, each closure device $\mathbf{210}_{P1}$,$\mathbf{210}_{P2}$ is arranged on the external side of the external wall of the drawer body 210 (i.e., the side thereof which does not face toward the multi-dose compartment $\mathbf{220}_1$,$\mathbf{220}_2$) where the corresponding emptying hole $\mathbf{210}_{H1}$,$\mathbf{210}_{H2}$ is located. In this way, when the drawer 115 is extracted from the drawer seat 120, the closure device can be advantageously accessed and operated by a user externally to the drawer for closing and opening the corresponding emptying hole.

In the illustrated embodiment, the closure devices $\mathbf{210}_{P1}$, $\mathbf{210}_{P2}$ are arranged on the external side of the drawer lateral walls $\mathbf{224}_1$, $\mathbf{224}_2$. According to another (not shown) embodiment, where the emptying holes are located on the drawer bottom wall 222, the closure devices $\mathbf{210}_{P1}$,$\mathbf{210}_{P2}$ are arranged on the external side of the drawer bottom wall 222.

Figure 3C:
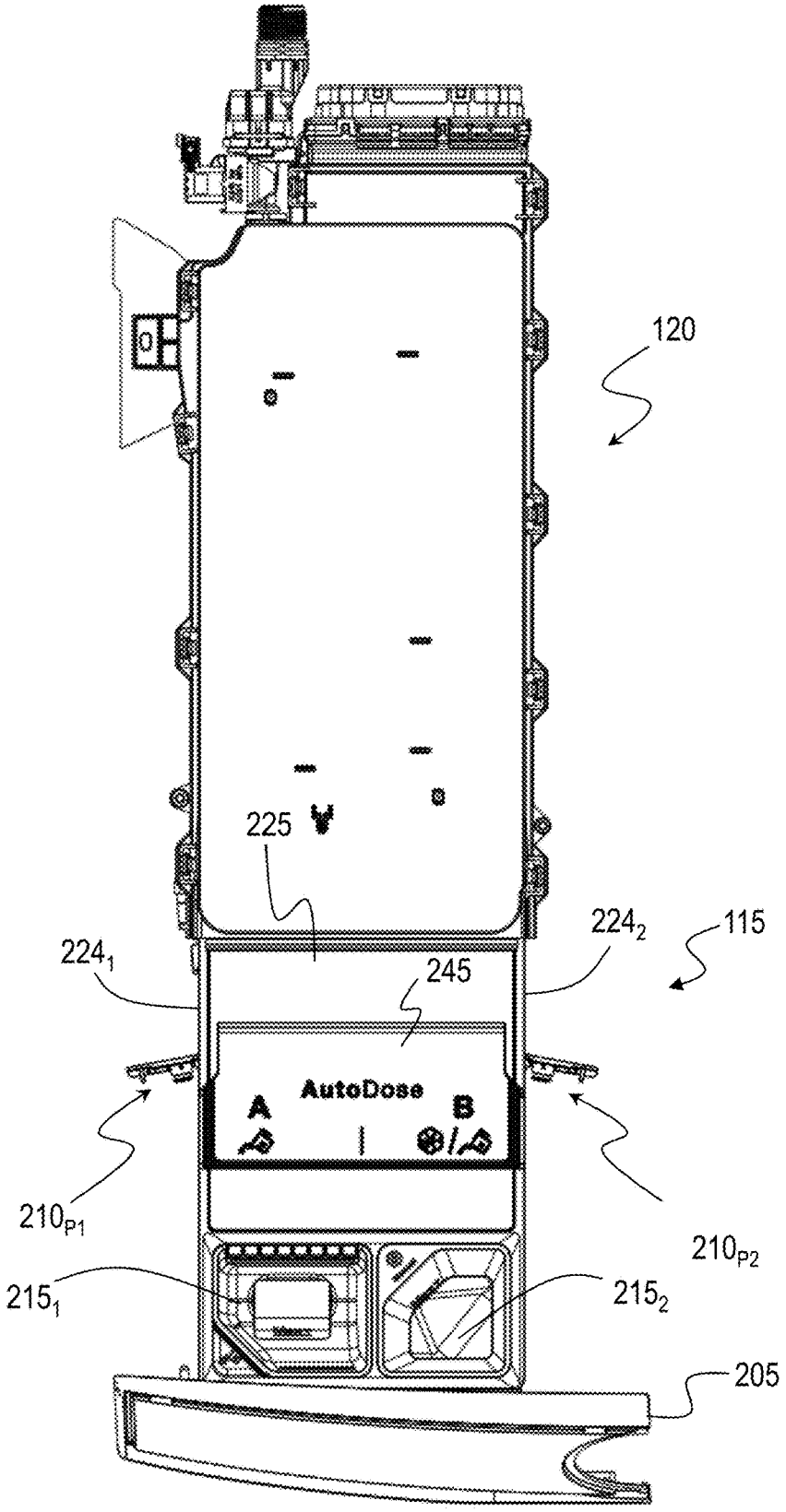
FIG. 3C is a top view of the drawer of FIG. 3B.

FIG. 3C is a top view of the drawer 115 when the closure devices $\mathbf{210}_{P1}$,$\mathbf{210}_{P2}$ are in the open position.

In FIG. 2A it is visible (in the closed position) only the closure device $\mathbf{210}_{P1}$. Both the closure devices $\mathbf{210}_{P1}$,$\mathbf{210}_{P2}$ are instead visible in FIG. 2B detached or removed from the drawer body 210.

Advantageously, each emptying hole $\mathbf{210}_{H1}$,$\mathbf{210}_{H2}$ is located, along the sliding direction X, in an advanced position of the drawer body 210 (i.e., towards the drawer handle 205). Therefore, when the drawer 115 is sufficiently extracted or pulled out from the drawer seat 120, as visible in FIGS. 3A-3C, the closure devices $\mathbf{210}_{P1}$,$\mathbf{210}_{P2}$ become accessible and can be switched to the open position (see FIG. 3B and FIG. 3C) to open the emptying holes $\mathbf{210}_{H1}$, $\mathbf{210}_{H2}$. Therefore, upon sufficient extraction or pulling out of the drawer 115 and opening of the closure devices $\mathbf{210}_{P1}$, $\mathbf{210}_{P2}$, the laundry treatment agent(s) in the multi-dose compartment(s) $\mathbf{220}_1$,$\mathbf{220}_2$ is caused to flow outside through the respective emptying hole(s) $\mathbf{210}_{H1}$,$\mathbf{210}_{H1}$, e.g. for being collected in a proper gathering container placed under the drawer 115 (the flowing of the laundry treatment agent outside the multi-dose compartments $\mathbf{220}_1$,$\mathbf{220}_2$ through the emptying holes $\mathbf{210}_{H1}$,$\mathbf{210}_{H2}$ being for example promoted by a proper slanting or other draining shape of the bottom wall 222 of the drawer body 210).

Figure 4:
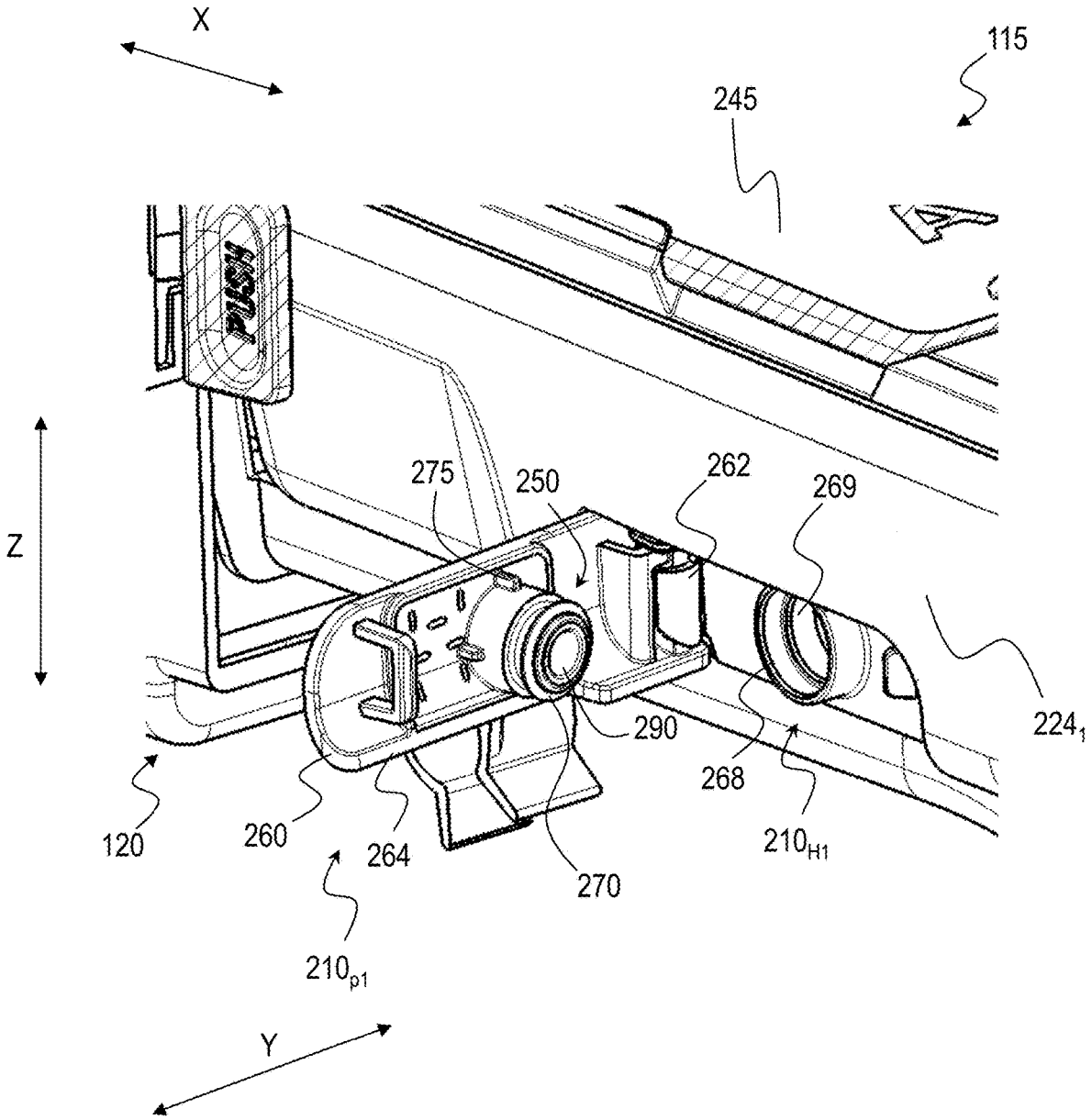
FIG. 4 shows in greater detail the emptying hole and the closure device of the drawer of the previous figures according to an embodiment of the present invention.

FIG. 4 illustrates in greater detail how the emptying hole $\mathbf{210}_{H1}$ and the closure device $\mathbf{210}_{P1}$ are structured according to an embodiment of the present invention. It has to be noted that the following description of the emptying hole $\mathbf{210}_{H1}$ and the closure device $\mathbf{210}_{P1}$ can be directly applied also to the emptying hole $\mathbf{210}_{H2}$ and to the closure device $\mathbf{210}_{P2}$. Moreover, similar considerations apply if the emptying hole(s) and the corresponding closure device(s) is/are located on the drawer bottom wall 222. Furthermore, similar considerations directly apply to emptying hole(s) and corresponding closure device(s) which are in fluid communication with the mono-dose compartments $\mathbf{215}_1$,$\mathbf{215}_2$.

The closure device $\mathbf{210}_{P1}$ comprises a plug element 250 adapted to be selectively fitted from outside the drawer 115 to the emptying hole $\mathbf{210}_{H1}$ for closing the emptying hole $\mathbf{210}_{H1}$ (closure device $\mathbf{210}_{P1}$ in the closed position) or unfitted from the emptying hole $\mathbf{210}_{H1}$ for opening the emptying hole $\mathbf{210}_{H1}$ (closure device $\mathbf{210}_{P1}$ in the open position).

According to the embodiment of the invention illustrated in the figures, the plug element 250 is a pin member, however similar considerations apply in case the plug element 250 has a different shape having an equivalent or similar function, such as if the plug element 250 is a screw member.

According to an embodiment of the present invention, the closure device $\mathbf{210}_{P1}$ comprises a flap member 260 configured to support the plug element 250. Preferably, although not exclusively, the flap member 260 has an elongated shape, for example substantially similar to a rectangular having the longer sides extending along the longitudinal direction X (when the closure device $210_{P1}$ is in the closed position); however, similar considerations apply in case the flap member 260 has a different shape, such as for example a squared or circular or semicircular one.

According to an embodiment of the present invention, the flap member 260 is hingedly coupled to the external side of the drawer lateral wall $224_1$ by means of a corresponding hinge 262 which advantageously allows the closure device $210_{P1}$ to rotate around a rotation axis parallel to the vertical direction Z between the open and closed positions.

According to an embodiment of the present invention, the flap member 260 is configured to be flush with the external wall of the drawer lateral wall $224_1$ when the closure device $210_{P1}$ is in the closed position, thus allowing the drawer 115 to completely slide into the drawer seat 120.

Advantageously, when the closure device $210_{P1}$ is in the open position, the flap member 260 protrudes from the drawer lateral wall $224_1$ at least along the transversal direction Y. This situation, which can be clearly seen making reference to FIG. 3C, is particularly useful because it prevents the user to forgot to close the emptying hole(s) $210_{H1}$,$210_{H2}$ before starting the operation of the laundry appliance 100. Indeed, if a closure device $210_{P1}$,$210_{P2}$ was accidentally left open, the corresponding protruding flap member 260 would enter into contact with borders of the drawer seat 120 when the drawer 115 is pushed to be retracted inside the drawer seat 120.

According to an embodiment of the present invention illustrated in the figures, the hinge 262 is located at the side of the flap member 260 which is the furthest from the drawer handle 205 (along the longitudinal direction X). In this way, if the drawer 115 is pushed for being retracted inside the drawer seat 120 with the closure device $210_P$ that is still opened, the borders of the drawer seat 120 may cause the flap member 260 to rotate around the rotation axis of the hinge 262 and closing the closure device $210_P$.

According to another embodiment of the present invention not illustrated in the figures, the hinge 262 is located at the side of the flap member 260 which is the closest to the drawer handle 205 (along the longitudinal direction X). In this way, if the drawer 115 is pushed for being retracted inside the drawer seat 120 with the closure device $210_P$ that is still opened, the retraction movement of the drawer 115 along the longitudinal direction X is halted when the flap member 260 enters into contact with the borders of the drawer seat 120, preventing the drawer 115 to completely slide into the drawer seat 120.

According to an embodiment of the present invention, the flap member 260 is advantageously provided with a recess (for example located on the lowest side of the flap member 262) defining a grip edge 264 for allowing a user to easily grip the flap member 260 during the rotation of the flap member 260 when the closure device 210*p* is switched from the closed position to the open position.

According to an embodiment of the present invention, the emptying hole $210_{H1}$ comprises two coaxial portions along the transversal direction Y: an external portion 268 (i.e., located at the external side of the drawer lateral wall $224_1$) having a first diameter and an internal portion 269 (i.e., located at the internal side of the drawer lateral wall $224_1$) having a second diameter lower than the first diameter.

According to an embodiment of the present invention, the plug element 250 comprises a sealing portion 270 adapted to seal the emptying hole $210_{H1}$ when the plug element 250 is fitted into the emptying hole $210_{H1}$ in order to avoid spilling of laundry treatment agent from the respective multi-dose compartment $220_1$.

According to an embodiment of the present invention, the sealing portion 270 comprises a flexible ring surrounding the tip of the plug element 250.

According to an embodiment of the present invention, the sealing portion 270 has a diameter substantially higher than the second diameter of the internal portion 269, so that, when the plug element 250 is fitted into the emptying hole $210_{H1}$, the sealing portion 270 abuts the internal portion 269, establishing a water tight closure of the emptying hole $210_{H1}$.

According to a further embodiment of the present invention, the sealing portion 270 comprises a flexible ring surrounding the tip of the plug element 250 and having a diameter slightly higher than the second diameter. In this way, when the plug element 250 is fitted into the emptying hole $210_{H1}$, the flexible ring of the sealing portion 270 deforms itself, passes into the internal portion 269 of the emptying hole $210_{H1}$ and then resiliently flexes toward the original shape, establishing a water tight closure of the emptying hole $210_{H1}$.

Since according to an embodiment of the present invention the first diameter of the external portion 268 is higher than the second diameter of the internal portion 269, the positioning of the sealing portion 270 against the internal portion 269 is facilitated during the rotation movement of the flap member 260 from the open to the closed positions of the closure device $210_{P1}$.

According to an embodiment of the present invention, the diameter of the flexible ring of the sealing portion 270 corresponds or is at most slightly lower than the first diameter of the external portion 268.

According to a further embodiment of the present invention, the first diameter of the external portion 268 is higher than the diameter of the flexible ring of the sealing portion 270 in order to facilitate the insertion of the sealing portion 270 into the internal portion 269 of the emptying hole $210_{H1}$ during the rotation movement of the flap member 260 from the open to the closed positions of the closure device $210_{P1}$.

According to an embodiment of the present invention, the plug element 250 is further provided with fin elements 275 adapted to abut a flange surrounding the external portion 268 of the emptying hole $210_{H1}$ when the closure device $210_{P1}$ is in the closed position for preventing (or at least reducing) occurrences of undesired axial movement (due to mechanical plays) of the plug element 250 within the emptying hole $210_{H1}$ on its closed position.

According to an embodiment of the present invention, while the flap member 260 is of the same material forming the walls of the drawer body 210 (e.g., propylene loaded with talc or calcium polycarbonate), at least the flexible ring of the sealing portion 270 and the fin elements 275 are preferably made of a different, more resilient material, such as a thermoplastic rubber. For example, the flexible ring of the sealing portion 270 and the fin elements 275 may be formed around an internal support element 290 of the plug element 250 by means of a bi-injection technique.

According to an alternative embodiment of the present invention, the plug element 250 is made of a rigid material and comprises a seat adapted to receive a gasket member, such as an O-ring.

According to an embodiment of the present invention, the drawer 115 comprises markers each one corresponding to a closure device $210_{P1}$,$210_{P2}$. Said markers are visible from the outside of the drawer 115 (when the drawer 115 is in the extracted position) for allowing the user to identify the closure device $\mathbf{210}_{P1}$,$\mathbf{210}_{P2}$ from the outside of the drawer.

According to an embodiment of the present invention, the markers may be textual indicators, sign indicators, colored indicators, and/or tactile effect indicators which allow to visually and/or tactilely identify the closure devices $\mathbf{210}_{P1}$, $\mathbf{210}_{P2}$.

According to an embodiment of the present invention, said markers are at least partially arranged on the drawer lateral walls $\mathbf{224}_1$, $\mathbf{224}_2$.

Making reference to the case illustrated in the figures wherein the emptying holes $\mathbf{210}_{H1}$,$\mathbf{210}_{H2}$ are located on the drawer lateral walls $\mathbf{224}_1$, $\mathbf{224}_2$, and the closure devices $\mathbf{210}_{P1}$,$\mathbf{210}_{P2}$ are arranged on the external side of the drawer lateral walls $\mathbf{224}_1$, $\mathbf{224}_2$, according to an embodiment of the present invention said markers are located on a portion of the closure devices $\mathbf{210}_{P1}$,$\mathbf{210}_{P2}$, and particularly on the face of the flap member 260 which is exposed when the closure devices $\mathbf{210}_{P1}$,$\mathbf{210}_{P2}$ are in the closed position.

Making reference to another case (not illustrated) wherein at least one emptying hole is located on the drawer bottom wall 222, and the respective closure device is located on the external side of the drawer bottom wall 222, even if the closure device is not directly visible by a user (being out of sight because of the drawer body 210 itself), according to an embodiment of the present invention a marker may be advantageously provided on a visible portion of the drawer 115 (such as on the drawer lateral walls $\mathbf{224}_1$, $\mathbf{224}_2$) to guide the user toward the closure device.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry treatment appliance comprising:

a cabinet accommodating a laundry treatment chamber; and a drawer configured to slide into the cabinet, the drawer comprising:

a plurality of external walls at least partially defining an external shape of a portion of the drawer sliding into the cabinet, at least one compartment configured to contain a laundry treatment agent, said compartment being delimited at least partially by at least a portion of at least one external wall of the plurality of external walls, wherein the portion of said at least one external wall comprises an emptying hole in fluid communication with the at least one compartment; and a closure device configured to selectively close and open said emptying hole, wherein the closure device is attached to an external side of the at least one external wall so as to be movable with the drawer and accessible and operable by a user externally to the drawer for closing and opening the corresponding emptying hole;

wherein the closure device comprises a flap member, said flap member being hingedly coupled to the drawer at the external side of the at least one external wall.

2. The laundry treatment appliance of claim 1, wherein said closure device comprises a sealing portion adapted to seal the emptying hole when the closure device closes the emptying hole in order to avoid spilling of laundry treatment agent from the compartment.

3. The laundry treatment appliance of claim 1, wherein said flap member is configured to be moved between:

a closed position, in which the closure device closes the emptying hole, and an open position, in which the closure device opens the emptying hole.

4. The laundry treatment appliance of claim 3, wherein said flap member is flush with the at least one external wall when it is in the closed position.

5. The laundry treatment appliance of claim 3, wherein said flap member comprises a grip edge for allowing a user to grip the flap member during the movement between the closed and open positions.

6. The laundry treatment appliance of claim 1, wherein said at least one external wall comprises at least one among a drawer bottom wall opposite to a top side of the drawer and drawer lateral walls each connecting said at least one bottom wall and a top side of the drawer.

7. The laundry treatment appliance of claim 1, wherein said at least one compartment comprises a compartment adapted to contain a single dose of said laundry treatment agent.

8. The laundry treatment appliance of claim 1, wherein said at least one compartment comprises a compartment adapted to contain multiple doses of said laundry treatment agent.

9. The laundry treatment appliance of claim 1, wherein said at least one compartment comprises at least two compartments each one adapted to contain multiple doses of said laundry treatment agent.

10. The laundry treatment appliance of claim 9, further comprising for each one of said at least two compartments a corresponding emptying hole and a corresponding closure device adapted to selectively closing and opening the corresponding emptying hole from outside the drawer.

11. The laundry treatment appliance of claim 10, wherein said emptying holes corresponding to such at least two compartments comprise a first emptying hole and a second emptying hole, the first emptying hole and the second emptying hole being located on opposite drawer lateral walls of the drawer.

* * * * *